US010753643B2

(12) United States Patent
Fang et al.

(10) Patent No.: US 10,753,643 B2
(45) Date of Patent: Aug. 25, 2020

(54) HEATING DEVICE AND PARTIAL RINSING DEVICE USING SAME

(71) Applicant: Xiamen Axent Corporation Limited, Xiamen (CN)

(72) Inventors: Yimin Fang, Xiamen (CN); Jianru Hu, Xiamen (CN); Jingquan Luo, Xiamen (CN); Ruimei Tang, Xiamen (CN)

(73) Assignee: XIAMEN AXENT CORPORATION LIMITED, Xiamen (CN)

( * ) Notice: Subject to any disclaimer, the term of this patent is extended or adjusted under 35 U.S.C. 154(b) by 74 days.

(21) Appl. No.: 15/767,105

(22) PCT Filed: Oct. 9, 2016

(86) PCT No.: PCT/CN2016/101543
§ 371 (c)(1),
(2) Date: Apr. 9, 2018

(87) PCT Pub. No.: WO2017/059809
PCT Pub. Date: Apr. 13, 2017

(65) Prior Publication Data

US 2019/0072297 A1 Mar. 7, 2019

(30) Foreign Application Priority Data

Oct. 10, 2015 (CN) ..... 2015 1 0652094

(51) Int. Cl.
*F24H 1/16* (2006.01)
*F24H 9/20* (2006.01)
(Continued)

(52) U.S. Cl.
CPC ..... *F24H 1/16* (2013.01); *F24H 9/0021* (2013.01); *F24H 9/2007* (2013.01);
(Continued)

(58) Field of Classification Search
CPC ..... F24H 1/16
See application file for complete search history.

(56) References Cited

U.S. PATENT DOCUMENTS 6,628,894 B2 * 9/2003 Winter ..... F24H 1/06 392/441
8,495,770 B2 * 7/2013 Koga ..... B05B 15/70 4/420.4
(Continued)

FOREIGN PATENT DOCUMENTS

CN 86203511 U 5/1987
CN 2250498 Y 3/1997
(Continued)

OTHER PUBLICATIONS

KR20030063065A—machine translation (Year: 2003).*
(Continued)

*Primary Examiner* — Nathaniel Herzfeld
(74) *Attorney, Agent, or Firm* — Schwabe Williamson & Wyatt, PC

(57) ABSTRACT

A heating device apparatus is provided, which includes: a first cavity, a heating member, a second cavity, a heat conducting member, a temperature detector and a controller. The heating member heats the fluid in the first cavity. The fluid inlet of the second cavity is in communication with the fluid outlet of the first cavity. The heat conducting member isolates the first cavity from the second cavity. The temperature detector detects the temperature of the fluid in the second cavity. The controller controls the heating of the heating member according to the temperature detected by the temperature detector. The fluid flows into the first cavity, is heated by the heating member, then flows into the second cavity, and performs heat exchange with the fluid in the first
(Continued)

cavity through the heat conducting member when the fluid flows through the second cavity.

8 Claims, 2 Drawing Sheets

(51) Int. Cl.
*F24H 9/00* (2006.01)
*B05B 1/24* (2006.01)
*E03D 9/08* (2006.01)

(52) U.S. Cl.
CPC ..... *F24H 9/2028* (2013.01); *B05B 1/24* (2013.01); *E03D 9/08* (2013.01)

(56) References Cited

U.S. PATENT DOCUMENTS

2006/0010624 A1* 1/2006 Cleland ..... A46B 13/06 15/29
2007/0143914 A1* 6/2007 Shirai ..... E03D 9/08 4/420.2
2011/0072570 A1* 3/2011 Morotomi ..... E03D 9/08 4/420.2
2011/0302709 A1* 12/2011 Taylor ..... A47K 7/08 4/443
2014/0105586 A1* 4/2014 Gallet ..... F24H 1/102 392/465

FOREIGN PATENT DOCUMENTS

| | | | | |
|---|---|---|---|---|
| CN | 2312425 | Y | | 3/1999 |
| CN | 103206779 | A | | 7/2013 |
| CN | 104807172 | A | | 7/2015 |
| JP | 2007003154 | A | | 1/2007 |
| JP | 2013104649 | A | | 5/2013 |
| KR | 20030063065 | A | * | 7/2003 |
| WO | 2011/030530 | A1 | | 3/2011 |
| WO | 2012/159585 | A1 | | 11/2012 |

OTHER PUBLICATIONS

International Search Report for PCT/CN2016/101543 dated Jan. 5, 2017; 6 pages including English translation.
European Patent Office: Extended European Search Report for EP Application No. 16853113.5 dated Apr. 17, 2019; 7 pages.

* cited by examiner

HEATING DEVICE AND PARTIAL RINSING DEVICE USING SAME

CROSS-REFERENCE TO RELATED APPLICATIONS

This application is a National phase application of PCT international patent application PCT/CN2016/101543, filed on Oct. 9, 2016 which claims priority to Chinese Patent Application No. 201510652094.5, titled "HEATING DEVICE AND PARTIAL RINSING DEVICE USING SAME", filed with the Chinese Patent Office on Oct. 10, 2015, both of which are incorporated herein by reference in their entireties.

FIELD

The present disclosure relates to a heating apparatus for heating a fluid and a private part cleaning device using the apparatus.

BACKGROUND

In the conventional private part cleaning device using the instant heating technology, water is heated to a specified temperature instantly by using a heating apparatus which can heat the water quickly. To ensure a temperature of the heated water to be uniform, the heating apparatus is usually provided with a buffer water tank in communication with a heating cavity. The buffer water tank is usually in communication with the heating cavity via a narrow water path, in this way, the heated water flows out after being mixed with the water in the buffer water tank in some extent. The heating apparatus has the following disadvantages.

On one hand, there is no good heat exchange between the heating cavity and the buffer water tank. When the water temperature rises suddenly, in order to cause the temperature of the superheated water after being mixed by the buffer water tank to be close to a normal temperature and avoid the superheated water from spraying to a private part of a human body, it is generally required to mix a large volume of a normal-temperature water with the superheated water. In this case, a volume of the buffer water tank is large, therefore an overall volume of the heating apparatus is large and further miniaturization of the heating apparatus cannot be realized. Moreover, since the water temperature is always higher than the normal temperature after the superheated water is mixed with the normal-temperature water in the buffer water tank, the user may feel uncomfortable. The heating apparatus cannot ensure the stability of an outlet water temperature reliably.

On the other hand, when special situations occur, such as water supply cutoff, the temperature of the water in the heating cavity rises sharply. Since the buffer water tank is in communication with the heating cavity via a narrow water path, there is no good heat exchange between the buffer water tank and the heating cavity. Hence, the temperature of the water in the buffer water tank rises slowly. A temperature detector arranged in the buffer water tank cannot know the situation and a controller cannot cut off the power supply in a timely manner to ensure safety. For this reason, it is required to add devices, such as a flowmeter, to detect the abnormal situations, which results in that the heating apparatus has more components and a high cost.

Solution to Problem

For the defects of the conventional technology, an embodiment of the present disclosure is to provide a heating apparatus with a small volume, a stable outlet water temperature, and fewer components, and a private part cleaning device using the apparatus.

A heating apparatus according to the present disclosure includes: a first cavity, a heating member, a second cavity, a heat conducting member, a temperature detector and a controller.

The heating member is configured to heat a fluid in the first cavity.

A fluid inlet of the second cavity is in communication with a fluid outlet of the first cavity.

The heat conducting member is configured to isolate the first cavity from the second cavity.

The temperature detector is configured to detect a temperature of a fluid in the second cavity.

The controller is configured to perform heating control on the heating member based on the temperature detected by the temperature detector.

The fluid flows into the first cavity and is heated by the heating member, then flows into the second cavity, and the fluid performs heat exchange with the fluid in the first cavity via the heat conducting member when the fluid flows through the second cavity.

Preferably, the temperature detector may be arranged at the fluid inlet of the second cavity.

Preferably, the heating apparatus may further include a housing and a heat conducting member accommodated in the housing. The housing is divided into the first cavity and the second cavity by the heat conducting member.

Preferably, the heat conducting member may have an inner surface and an outer surface. The heating member is accommodated in the heat conducting member. The first cavity is formed between an outer surface of the heating member and the inner surface of the heat conducting member, and the second cavity is formed between the outer surface of the heat conducting member and an inner surface of the housing.

Preferably, the heat conducting member may have an upper surface and a lower surface. The heating member is accommodated in a cavity formed between the housing and the lower surface of the heat conducting member, and the second cavity is formed between the upper surface of the heat conducting member and the housing.

Preferably, the inner surface of the housing may have a spiral shape winding along an outer peripheral surface of the heat conducting member.

Preferably, the heat conducting member may be made of a metal heat conducting material.

Preferably, the heat conducting member may be made of a copper material.

A private part cleaning device is further provided according to the present disclosure, which includes: a cleaning component, a water supply component and a heating apparatus.

The cleaning component is configured to spray water to a private part of a human body.

The water supply component is configured to supply the water to the cleaning component.

The heating apparatus is configured to heat the water supplied to the cleaning component instantly. The heating apparatus includes: a first cavity, a heating member, a second cavity, a heat conducting member, a temperature detector and a controller.

The heating member is configured to heat a fluid in the first cavity.

A fluid inlet of the second cavity is in communication with a fluid outlet of the first cavity.

The heat conducting member is configured to isolate the first cavity from the second cavity.

The temperature detector is configured to detect a temperature of the fluid in the second cavity.

The controller is configured to perform heating control on the heating member based on the temperature detected by the temperature detector.

The fluid flows into the first cavity and is heated by the heating member, then flows into the second cavity, and the fluid performs heat exchange with the fluid in the first cavity via the heat conducting member when the fluid flows through the second cavity.

Technical Effect

1. According to the present disclosure, the fluid inlet of the second cavity is in communication with the fluid outlet of the first cavity. The fluid flows into the first cavity and is heated by the heating member, then flows into the second cavity. The fluid performs heat exchange with the fluid in the first cavity via the heat conducting member when the fluid flows through the second cavity. Hence, the controller can quickly acquire feedback from the temperature detector, so that the controller performs heating control on the heating member. The heat exchange is performed between the fluid in the second cavity before the heating control and the fluid in the first cavity after the heating control, so that the heating apparatus has a stable outlet water temperature. Moreover, the heating apparatus has a small volume since it is not necessary to provide a buffer water tank with a large volume.

When a temperature of the heating apparatus suddenly rises, the controller can quickly acquire the feedback from the temperature detector, and the controller performs heating control on the heating member. The heat exchange is performed between the fluid in the second cavity before the heating control and the fluid in the first cavity after the heating control, such that the temperature can be rapidly adjusted. When abnormal situations occur, such as water supply cutoff, a temperature in the first cavity rises rapidly. Since there is good heat exchange between the first cavity and the second cavity, a temperature in the second cavity also rises rapidly. Then the temperature detector arranged in the second cavity detects the abnormal situation and feeds back the situation to the controller quickly, and the controller cuts off power supplied to the heating apparatus to avoid security risks. In this way, abnormity detection can be performed without adding other devices to the heating apparatus according to the present disclosure, such as a flowmeter, such that the heating apparatus has fewer components and a low cost.

2. The temperature detector is arranged at the fluid inlet of the second cavity, such that the temperature is fed back to the controller quickly, and thus the controller performs control quickly.

3. The heating apparatus includes a housing and a heat conducting member accommodated in the housing. The housing is divided into the first cavity and the second cavity by the heat conducting member. The heating member is accommodated in the heat conducting member. The heat conducting member has an inner surface and an outer surface. The heating member is accommodated in the heat conducting member. The first cavity is formed between an outer surface of the heating member and the inner surface of the heat conducting member, and the second cavity is formed between the outer surface of the heat conducting member and an inner surface of the housing. The heating apparatus has a compact structure and a small volume.

4. The heat conducting member is made of a metal heat conducting material, preferably a copper material, such that heat exchange is fully performed between the fluid in the second cavity and the fluid in the first cavity. The temperature after heating is fed back to the temperature detector accurately and quickly, and an outlet water temperature is uniform, thereby avoiding the discomfort caused by a temperature sudden change in some extent.

5. The inner surface of the housing has a spiral shape winding along an outer peripheral surface of the heat conducting member. Hence, the fluid in the second cavity presents a spiral shape, such that a flow distance of the fluid is long. Not only a mixing time for the fluid itself in the second cavity is long, but also a time for performing heat exchange between the fluid in the second cavity and the fluid in the first cavity is long, therefore the outlet water temperature is stable.

DETAILED DESCRIPTION OF EMBODIMENTS

The heating apparatus and the private part cleaning device using the apparatus are described hereinafter in conjunction with the drawings.

Figure 1:
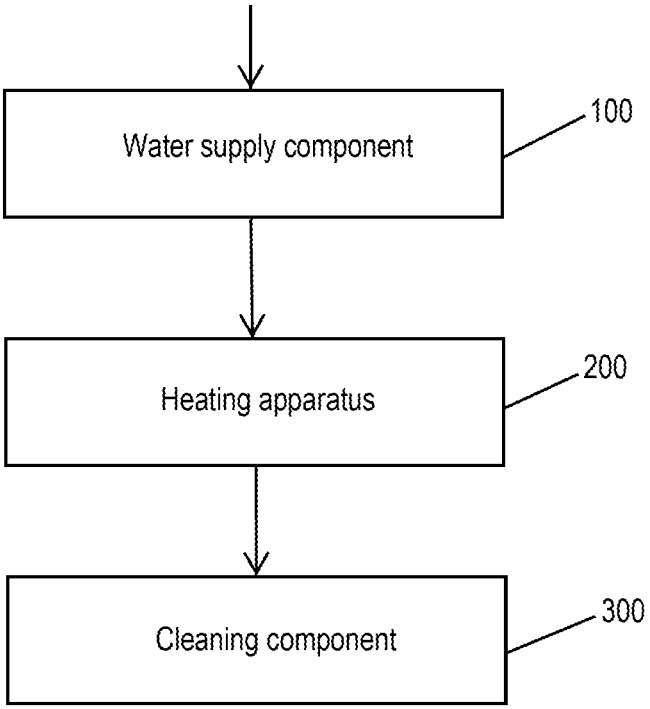
FIG. 1 is a schematic view showing a principle of a private part cleaning device according to the present disclosure.

As illustrated in FIG. 1, the private part cleaning device according to the present disclosure includes a cleaning component 300, a water supply component 100 and a heating apparatus 200. The cleaning component 300 is configured to spray water to a private part of a human body. The water supply component 100 is configured to supply the water to the cleaning component 300. The heating apparatus 200 is configured to heat the water supplied to the cleaning component 300 instantly.

Figure 2:
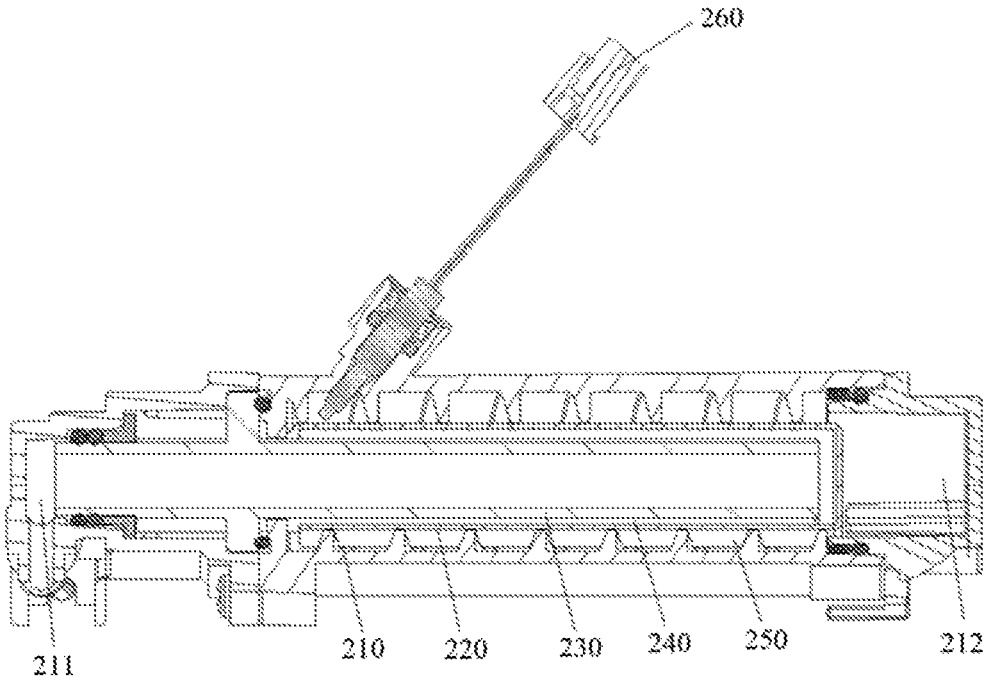
FIG. 2 is a schematic structural view of a heating apparatus according to the present disclosure.

FIG. 2 is a schematic structural view of a heating apparatus according to the present disclosure. The heating apparatus 200 includes a housing 210, a cylindrical heat conducting member 220 accommodated in the housing, and a heating member 230 accommodated in the heat conducting member 220. The housing is provided with a water inlet 211 and a water outlet 212. An inner surface of the housing 210 has a spiral shape winding along an outer peripheral surface of the heat conducting member 220. A first cavity 240 is formed between an outer surface of the heating member 230 and an inner surface of the heat conducting member 220, and a second cavity 250 is formed between an outer surface of the heat conducting member 220 and an inner surface of the housing 210. An inlet of the second cavity 250 is in communication with an outlet of the first cavity 240. The water flow flows into the heating apparatus via the water inlet 211 and is heated by the heating member 230 when flowing through the first cavity 240, then flows through the second cavity 250 and performs heat exchange with the water flow in the first cavity 240 via the heat conducting member 220, and flows out via the water outlet 212 finally.

The heating apparatus 200 further includes a temperature detector 260 and a controller. The temperature detector 260 is configured to detect a temperature of the water flow in the second cavity. The controller is configured to perform heating control on the heating member 230 based on the temperature detected by the temperature detector 260. Preferably, the temperature detector 260 is arranged at the inlet of the second cavity 250, such that the temperature is fed back to the controller quickly, and thus the controller performs control quickly. The temperature of the heated water can be detected by the temperature detector 260 quickly and fed back to the controller. The controller can adjust a heating power of the heating member 230 in response to the feedback, such that the controller can know the temperature of the water expected by a user quickly. In a case that the temperature of the water exceeds a specified temperature, the temperature detector 260 feeds back a signal indicating the excessive temperature to the controller, and the controller cuts off power supplied to the heating member 230.

The heat conducting member 220 is made of a metal heat conducting material, such that heat exchange is fully performed between the fluid in the second cavity 250 and the fluid in the first cavity 240. The temperature after heating is fed back to the temperature detector 260 accurately and quickly, and an outlet water temperature is uniform, thereby avoiding the discomfort caused by a temperature sudden change in some extent. Preferably, the heat conducting member 220 is made of copper. Since copper has an excellent heat conduction performance and corrosion resistance, heat exchange is performed well between the water in the second cavity 250 and the water in the first cavity 240.

The action process of the private part cleaning device according to the present disclosure is as follows. When partial cleaning is required, the water supply component 100 is turned on, and water flows from the outside into the water supply component 100, then flows into the heating apparatus 200. The water conveyed to the heating apparatus 200 is heated to a default temperature instantly while flowing in the heating apparatus 200. Then the water is conveyed to the cleaning component 300 and sprayed to a private part of a human body for cleaning. A water path of the water supply component 100 is turned off after cleaning is completed.

The flowing of the water in the heating apparatus 200 is described specifically hereinafter. The water flows via the water inlet 211 of the housing into the inner surface of the heating member 230, then flows through the first cavity 240 formed between the outer surface of the heating member 230 and the inner surface of the heat conducting member 220. In this case, the water flow is heated by the heat generated on the outer surface of the energized heating member 230 while flowing in the first cavity 240. The heated water flow flows through the second cavity 250 formed between the outer surface of the heat conducting member 220 and the inner surface of the housing 210. In this case, the water flow is supplied to the temperature detector 260 for temperature detection. The temperature detector 260 feeds back the detected temperature data signal to the controller. The controller compares the detected temperature with the default preset temperature, and adjusts a heating power of the heating member 230 to make the detected temperature consistent with the default preset temperature.

Meanwhile, the water flow performs heat exchange with the water flow in the first cavity 240 via the heat conducting member 220 while flowing in the second cavity 250. Since the inner surface of the housing 210 has a spiral shape, the water flow presents a spiral shape extending along the outer surface of the heat conducting member 220. In this case, the water flow has a long flow distance. Not only a mixing time for the water flow itself in the second cavity 250 is long, but also a time for performing heat exchange between the water flow in the second cavity 250 and the water flow in the first cavity 240 arranged in the heat conducting member 220 is long. The water temperature does not change suddenly, and the water flow mixed uniformly flows out via the water outlet 212 finally.

The heat conducting member of the heating apparatus according to the present disclosure may also have upper and lower surfaces with a flat shape or other shape. The heating member is accommodated in a cavity formed between the housing and the lower surface of the heat conducting member, and a second cavity is formed between the upper surface of the heat conducting member and the housing. The upper and lower surfaces here are relative, and the structure of the heat conducting member is not specifically limited.

Compared with the conventional technology, the heating apparatus according to the present disclosure has a small volume since it is not necessary to provide a buffer water tank with a large volume, which is beneficial to a miniaturization of the heating apparatus and the private part cleaning device. When a temperature of the heating apparatus suddenly rises, the controller can quickly acquire the feedback from the temperature detector, and the controller performs heating control on the heating member. The heat exchange is performed between the fluid in the second cavity before the heating control and the fluid in the first cavity after the heating control, such that the temperature can be rapidly adjusted. When abnormal situations occur, such as water supply cutoff, a temperature in the first cavity rises rapidly. Since there is good heat exchange between the first cavity and the second cavity, the temperature in the second cavity also rises rapidly. Then the temperature detector arranged in the second cavity detects the abnormal situations and feeds back the situation to the controller quickly, and the controller cuts off power supplied to the heating apparatus to avoid security risks. In this way, abnormity detection can be performed without adding other devices to the heating apparatus according to the present disclosure, such as a flowmeter, such that the heating apparatus has fewer components and a low cost.

INDUSTRIAL APPLICABILITY

Compared with the conventional technology, the heating apparatus according to the present disclosure has a small volume since it is not necessary to provide a buffer water tank with a large volume, which is beneficial to a miniaturization of the heating apparatus and the private part cleaning device. When a temperature of the heating apparatus suddenly rises, the controller can quickly acquire the feedback from the temperature detector, and the controller performs heating control on the heating member. The heat exchange is performed between the fluid in the second cavity before the heating control and the fluid in the first cavity after the heating control, such that the temperature can be rapidly adjusted. When abnormal situations occur, such as water supply cutoff, a temperature in the first cavity rises rapidly. Since there is good heat exchange between the first cavity and the second cavity, the temperature in the second cavity also rises rapidly. Then the temperature detector arranged in the second cavity detects the abnormal situations and feeds back the situation to the controller quickly, and the controller cuts off power supplied to the heating apparatus to avoid security risks. In this way, abnormity detection can be performed without adding other devices to the heating apparatus according to the present disclosure, such as a flowmeter, such that the heating apparatus has fewer components and a low cost.

The invention claimed is:

1. A heating apparatus, comprising:

a first cavity;

a heating member configured to heat a fluid in the first cavity;

a second cavity, wherein a fluid inlet of the second cavity is in communication with a fluid outlet of the first cavity;

a heat conducting member configured to isolate the first cavity from the second cavity;

a temperature detector configured to detect a temperature of a fluid in the second cavity, wherein the temperature detector is arranged at the fluid inlet of the second cavity; and a controller configured to perform heating control on the heating member based on the temperature detected by the temperature detector, wherein the fluid flows into the first cavity and is heated by the heating member, then flows into the second cavity, and the fluid performs heat exchange with the fluid in the first cavity via the heat conducting member when the fluid flows through the second cavity, wherein, the heating apparatus further comprising a housing, wherein the heat conducting member is accommodated in the housing, and the housing is divided into the first cavity and the second cavity by the heat conducting member, wherein the heat conducting member has an inner surface and an outer surface, the heating member is accommodated in the heat conducting member, the first cavity is formed between an outer surface of the heating member and the inner surface of the heat conducting member, and the second cavity is formed between the outer surface of the heat conducting member and an inner surface of the housing.

2. The heating apparatus according to claim 1, wherein the inner surface of the housing has a spiral shape winding along an outer peripheral surface of the heat conducting member.

3. The heating apparatus according to claim 1, wherein the heat conducting member is made of a metal heat conducting material.

4. The heating apparatus according to claim 3, wherein the heat conducting member is made of a copper material.

5. A private part cleaning device, comprising:

a cleaning component configured to spray water to a private part of a human body;

a water supply component configured to supply the water to the cleaning component; and a heating apparatus configured to heat the water supplied to the cleaning component instantly, wherein the heating apparatus comprises:

a first cavity;

a heating member configured to heat a fluid in the first cavity;

a second cavity, wherein a fluid inlet of the second cavity is in communication with a fluid outlet of the first cavity;

a heat conducting member configured to isolate the first cavity from the second cavity;

a temperature detector configured to detect a temperature of a fluid in the second cavity, wherein the temperature detector is arranged at the fluid inlet of the second cavity; and a controller configured to perform heating control on the heating member based on the temperature detected by the temperature detector, wherein the fluid flows into the first cavity and is heated by the heating member, then flows into the second cavity, and the fluid performs heat exchange with the fluid in the first cavity via the heat conducting member when the fluid flows through the second cavity, wherein, the heating apparatus further comprises a housing, the heat conducting member is accommodated in the housing, and the housing is divided into the first cavity and the second cavity by the heat conducting member, wherein the heat conducting member has an inner surface and an outer surface, the heating member is accommodated in the heat conducting member, the first cavity is formed between an outer surface of the heating member and the inner surface of the heat conducting member, and the second cavity is formed between the outer surface of the heat conducting member and an inner surface of the housing.

6. The private part cleaning device according to claim 5, wherein the inner surface of the housing has a spiral shape winding along an outer peripheral surface of the heat conducting member.

7. The private part cleaning device according to claim 5, wherein the heat conducting member has an upper surface and a lower surface, the heating member is accommodated in a cavity formed between the housing and the lower surface of the heat conducting member, and the second cavity is formed between the upper surface of the heat conducting member and the housing.

8. The private part cleaning device according to claim 5, wherein the heat conducting member is made of a metal heat conducting material.

* * * * *